US008038869B2

(12) United States Patent
Kalnes

(10) Patent No.: US 8,038,869 B2
(45) Date of Patent: Oct. 18, 2011

(54) INTEGRATED PROCESS FOR UPGRADING A VAPOR FEED

(75) Inventor: Tom N. Kalnes, LaGrange, IL (US)

(73) Assignee: UOP LLC, Des Plaines, IL (US)

( * ) Notice: Subject to any disclaimer, the term of this patent is extended or adjusted under 35 U.S.C. 154(b) by 524 days.

(21) Appl. No.: 12/164,434

(22) Filed: Jun. 30, 2008

(65) Prior Publication Data

US 2009/0321312 A1 Dec. 31, 2009

(51) Int. Cl.
*C10G 47/00* (2006.01)

(52) U.S. Cl. ..... 208/103; 208/100; 208/95; 208/142; 208/143

(58) Field of Classification Search ..... 208/100, 208/46, 142, 143; 55/301, 318, 320
See application file for complete search history.

(56) References Cited

U.S. PATENT DOCUMENTS 3,958,952 A * 5/1976 van Ginneken ..... 55/419
3,960,508 A 6/1976 Bessant et al.
3,996,015 A 12/1976 Hutchings
4,234,314 A 11/1980 Jones
4,568,595 A * 2/1986 Morris ..... 55/523
4,746,338 A * 5/1988 Williams ..... 55/482
5,013,424 A 5/1991 James, Jr. et al.
5,543,059 A * 8/1996 Howson et al. ..... 210/757
5,755,955 A * 5/1998 Benham et al. ..... 208/100
6,258,900 B1 7/2001 Glover
6,306,287 B1 10/2001 Billon et al.
6,858,127 B2 2/2005 Hoek et al.
7,157,013 B2 1/2007 Erfan
2005/0241991 A1 11/2005 Lott et al.
2007/0017850 A1 1/2007 Euzen et al.
2007/0215521 A1 9/2007 Havlik et al.

* cited by examiner

*Primary Examiner* — Glenn Caldarola
*Assistant Examiner* — Michelle Stein
(74) *Attorney, Agent, or Firm* — James C. Paschall

(57) ABSTRACT

Processes and systems are provided for removing contaminants from a vapor stream containing hydrocarbon and hydrogen, and can include: providing a feed stream to a first pressurized vapor liquid separator that produces a liquid stream and a vapor stream containing hydrocarbon and hydrogen, passing the vapor stream to an inlet of a particulate trap containing a plurality of treatment zones that remove contaminants from the vapor stream to produce a particulate trap effluent, and passing the particulate trap effluent directly to a catalytic hydrogenation zone. The processes and systems can also include: passing the liquid stream from the first pressurized vapor liquid separator to a second vapor liquid separator that produces an overhead vapor stream and a liquid bottoms stream, condensing the overhead vapor stream from the second vapor liquid separator to form a liquid overhead stream, routing the liquid overhead stream to the inlet of the particulate trap.

19 Claims, 2 Drawing Sheets

INTEGRATED PROCESS FOR UPGRADING A VAPOR FEED

TECHNICAL FIELD

This disclosure relates to processes for removing contaminants from a hydrocarbon-containing vapor stream. More particularly, this disclosure relates to processes for removing contaminants from a hydrocarbon-containing vapor stream prior to the vapor stream being routed to a catalytic hydrogenation zone.

DESCRIPTION OF RELATED ART

Various chemical processes generate hydrocarbon-containing vapor stream that is routed to a catalytic hydrogenation zone. Such processes can include, but are not limited to, slurry hydrocracking processes, as well as processes for the recycling and reprocessing of used petroleum based products, such as waste lubricating oils, or oil derived from carbonaceous waste.

Slurry hydrocracking processes relate to the upgrading of residual oils and, more particularly, to the hydroconversion of heavy residual oils. Heavy residual oils can be such materials as high sulfur bitumen, crude oil atmospheric column bottoms, crude oil vacuum column bottoms, heavy cycle oil, shale oils, coal derived liquids, and the heavy bituminous oils extracted from oil sands. For example, in the refining of crude oil, slurry hydrocrackers are used to convert non-distillable carbonaceous components to lower molecular weight distillate products and remove soluble impurities such as sulfur, nitrogen, and metals from the starting feedstock. They are also used in conjunction with fixed bed hydro treating and hydrocracking units to convert the low value feed info valuable hydrotreated products such as naphtha, jet fuel, kerosene and diesel. In these cases, slurry hydrocracking reactor effluent can become a feedstock to a hot, high pressure separator to produce a vapor fraction and a liquid fraction containing heavier distillate components. The vapor fraction can in turn be passed directly to a catalytic hydrotreating reactor to produce a hydrotreated product.

Processes for the recycling and reprocessing of used petroleum based products include, for example processes for recovering hydrocarbons from contaminated hydrocarbons. The recovered hydrocarbons can be used for commercial purposes, such as lubricants, solvents, and fuels. Contaminated hydrocarbons can comprise a non-distillable component, such as high molecular weight tars, metals, degraded chemical additives, and solids, that are detrimental to the use of these oils as lubricants. Contaminated hydrocarbons can be separated to al least some degree by contacting the hydrocarbons with a stream of hot hydrogen gas to vaporize at least a portion of the hydrocarbon components in the contaminated hydrocarbons in a feed flash separator, producing a hydrocarbon-containing, hydrocarbonaceous vapor, stream and a heavy stream containing non-distillable components. The resulting hydrocarbon-containing, hydrocarbonaceous vapor stream can be introduced into a catalytic demetallization zone. The hydrocarbonaceous effluent from the catalytic demetallization reaction zone can then be introduced into a catalytic hydroprocessing reaction zone in order to produce higher hydrogen content hydrocarbons containing lower concentrations of hetero-atoms. Further processing can then be utilized to produce high quality hydrocarbon product streams. One commercial example of such a process is the Hylube process developed by UOP, which relates to the catalytic processing of used, lubricating oils to produce re-refined lube base-stocks for re-blending into saleable lube oils.

SUMMARY

Contaminant removal processes and systems disclosed herein can be utilized in any suitable process where the vapor leaving a vapor liquid separator is passed directly to a catalytic hydrogenation zone.

In one aspect, a process for removing contaminants from a vapor stream containing hydrocarbon and hydrogen is provided that includes: providing a feed stream to a first pressurized vapor liquid separator that produces a liquid stream and a vapor stream containing hydrocarbon and hydrogen, passing the vapor stream to an inlet of a particulate trap containing a plurality of treatment zones that remove contaminants from the vapor stream to produce a particulate trap effluent, and passing the particulate trap effluent directly to a catalytic hydrogenation zone. The pressurized vapor liquid separator, the particulate trap, and the catalytic hydrogenation zone can each have an operation pressure of from about 50 psi to about 3000 psi. In some examples, the pressurized vapor liquid separator can have an operation pressure of from about 50 psi to about 3000 psi, the particulate trap can have an operation pressure that differs from the operation pressure of the first pressurized vapor liquid separator by an amount of about 50 psi or less, and the catalytic hydrogenation zone has ah operation pressure that differs from the operation pressure of the particulate trap by an amount of about 50 psi or less. The process can also include: passing the liquid stream from the first pressurized vapor liquid separator to a second vapor liquid separator that produces an overhead vapor stream and a liquid bottoms stream, condensing the overhead vapor stream from the second vapor liquid separator to form a liquid overhead stream, routing the liquid overhead stream to the inlet of the particulate trap. In such instances, the second vapor liquid separator can be a fractionator and preferably a steam stripping column, such as a vacuum steam stripping column, and can have an operation pressure less than the first pressurized vapor liquid separator.

In another aspect, a system for removing contaminants from a vapor stream containing hydrocarbon and hydrogen is provided. The system includes a first pressurized vapor liquid separator that receives a feed stream, and that produces a liquid stream and a vapor stream containing hydrocarbon and hydrogen. The system also includes a particulate trap containing a plurality of treatment zones that removes contaminants from the vapor stream to produce a particulate trap effluent. The system further includes a catalytic hydrogenation zone that receives the particulate trap effluent directly from the particulate trap. The first pressurized vapor liquid separator, the particulate trap and the hydrogenation zone can each have an operation pressure of from about 50 psi to about 3000 psi.

BRIEF DESCRIPTION OF THE DRAWINGS

Specific examples have been chosen for purposes of illustration and description, and are shown in the accompanying drawings, forming a part of the specification.

DETAILED DESCRIPTION

Figure 1:
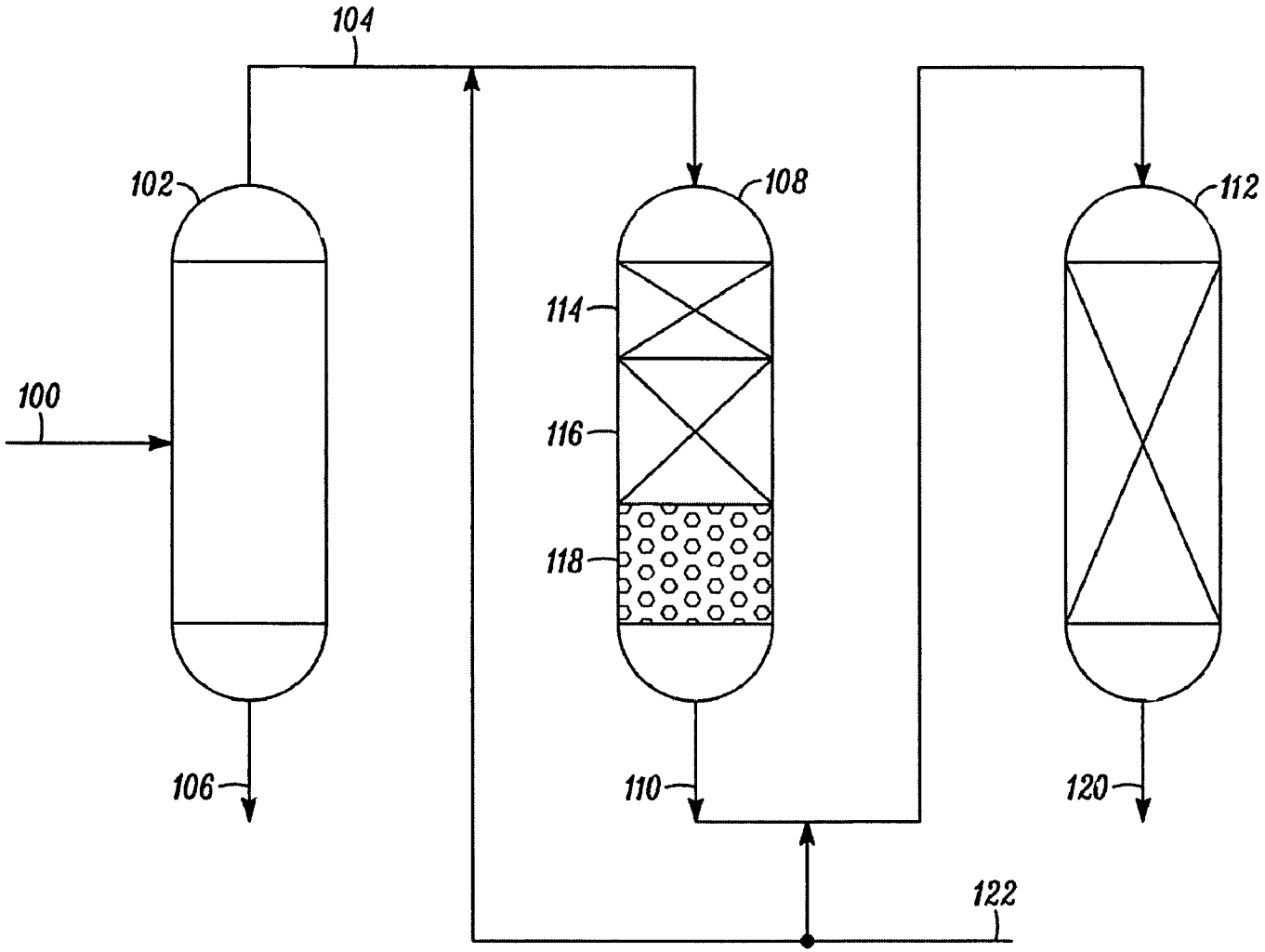
FIG. 1 illustrates a simplified schematic diagram including a liquid vapor separator, a particulate trap, and a catalytic hydrogenation zone.
Figure 2:
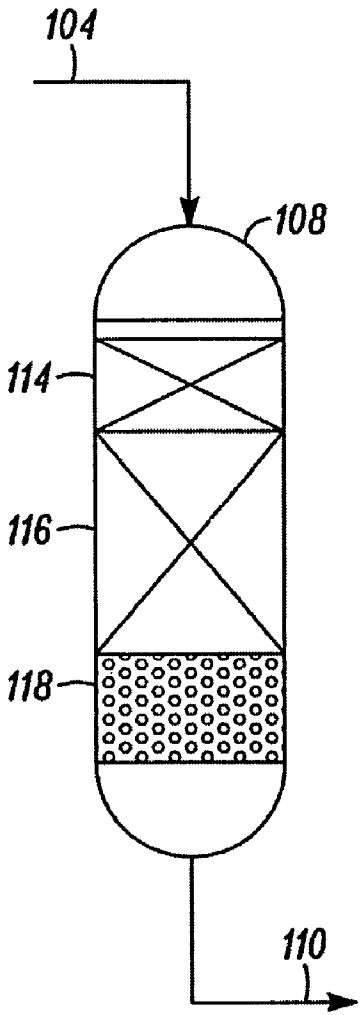
FIG. 2 illustrates the particulate trap of FIG. 1.

Feed streams that can be utilized in the systems and processes disclosed herein can include, but are not limited to any carbonaceous waste streams, petroleum based products or byproducts, whether natural or man-made, such as product streams or residua produced during petroleum refining, and/or any liquid oil derived from biomass, such as pyrolysis oil. Carbonaceous waste streams can include, for example, waste lubricating oils such as hydraulic fluids, heat transfer fluids, engine lubricants, and cutting oils. Pyrolysis oil refers to oils derived from the rapid heating of materials under an oxygen lean environment where the organic material breaks down to form a liquid. Such derivation includes pyrolysis or chemical depolymerization of biomass, such as the lignin fraction of sawdust and the like, and also the heating and depolymerization of waste plastics that are synthetic polymers. Waste plastics that are synthetic polymers can be characterized by high aliphatic content, such as polyethylene, polypropylene, and polystyrene, made from olefin monomers. Petroleum based products and byproducts can include, for example, slurry oil from FCC processes, atmospheric residuum, spent solvents and still bottoms from solvent recovery operations, used dielectric fluids, hydrocarbons contaminated with chlorinated biphenyls, coal tars, halogenated wastes, unconventional crudes that are contaminated with high amounts of non-distillable solids, such as Canadian oil sands, high acid number South American bitumens, and unrefined shale oils. Other potential feed streams include, for example, synthetic materials, such as chlorinated byproducts from manufacture of vinyl chloride monomer and propylene oxide, waste of off-spec polymers, oils derived from depolymerizing old tires and other plastics and rubbers, as well as biologically derived oils such as black liquor from pulp and paper, tall oils, vegetable oils containing alkaline metals or salts, waste greases, tallow oils and other oils derived from animal fats.

In some examples, the feed stream for a process or system disclosed herein can be at least one of a waste lubricating oil, a pyrolysis oil, or an effluent stream from a slurry hydrocracking reactor. The feed stream can also be a combination of at least one waste lubricating oil and at least one a pyrolysis oil.

Feed streams that can be utilized in the systems and processes disclosed herein tend to contain contaminants. Such contaminants can be, for example, inorganic contaminants or non-volatile carbonaceous contaminants. These can include, but are not limited to, non-distillable components, particulate matter such as iron, and spent additive contaminants such as zinc, phosphorous, and calcium. Non-limiting examples of non-distillable components are solids, such as metals and tars found in used lubricating oil, silica found in tar-sands, additive metals and finely divided particulate matter found in depolymerized oils, and other contaminants found in the feed streams addressed above. Contaminants can also include silicon, phosphorous, arsenic, and organic molecules containing these elements.

It is desirable to remove such contaminants from the vapor stream, and from the components thereof that are provided to a catalytic hydrogenation zone. Non-distillable contaminants can foul hot heat exchange surfaces which are used to heat or cool feed streams to reaction conditions, and can also form coke or otherwise deactivate the catalyst utilized in a catalytic hydrogenation zone, thereby shortening its active life. Additionally, particulate matter in a feed stream tends to deposit within the catalyst reaction zones and to plug fixed catalyst beds thereby reducing processing capacity and/or abbreviating the time on stream.

Accordingly, as illustrated in FIG. 1, a feed stream 100 can be provided to a first pressurized vapor liquid separator 102 that produces a liquid stream 106 and a vapor stream 104 containing hydrocarbon and hydrogen. The pressurized vapor liquid separator 102 can be, for example, a hot, high pressure separator such as those utilized in slurry hydrocracking processes, or a feed flash separator such as those utilized in a Hylube process. In at least one example, a hot, high pressure separator can have an operation temperature from about 295° C. to about 395° C. (about 563° F. and 743° F.), from about 320° C. to about 395° C. (about 608° F. to about 743° F.), or from about 330° C. to about 360° C. (about 626° F. to about 680° F.). In another example, a feed flash separator can have an operation temperature from about 200° C. (about 392° F.) to about 650° C. (about 1,200° F.). The pressurized vapor liquid separator 102 preferably has an operation pressure of from about 50 psi to about 3000 psi, or from about 400 psi to about 1200 psi.

A vapor stream 104 containing hydrocarbon and hydrogen can be recovered from the vapor liquid separator 102. The hydrogen in the vapor stream can have a partial pressure that is up to about 95% of the total pressure of the vapor stream. For example, the hydrogen in the vapor stream can have a partial pressure that is from about 47.5 psi to about 2850 psi, or from about 380 psi to about 1140 psi. Vapor stream 104 can include contaminants that were not separated but of the feedstock into the liquid stream of the vapor liquid separator. The vapor stream 104 can be passed to an inlet of a particulate trap 108.

Particulate trap 108 can contain a plurality of treatment zones that remove contaminants from the vapor stream 104 to produce a particulate trap effluent 110. Contaminants removed from the vapor stream comprise at least one of inorganic contaminants or non-volatile carbonaceous contaminants. The removal of contaminants can be a complete removal or a partial removal, such as a reduction in the amount of at least one contaminant. The particulate trap 108 can have an operation temperature from about 200° C. (about 392° F.) to about 650° C. (about 1,200° F.), from about 295° C. to about 400° C. (about 563° F. to about 752° F.), or from about 330° C. to about 398° C. (about 626° F. to about 748° F.). The particulate trap 108 can have an operation pressure of from about 50 psi to about 3000 psi, or from about 400 psi to about 1200 psi. Preferably, the particulate trap 108 can have an operation temperature and an operation pressure similar to those of the pressurized vapor liquid separator 102. For example, the operation pressure of the pressurized vapor liquid separator 102 and the operation pressure of the particulate trap 108 preferably have a difference of about 50 psi or less.

Particulate trap 108 can be organized in a vertical orientation or a horizontal orientation. In some examples, a single particulate trap can be used. In alternative examples, two or more particulate traps can be utilized, either in series or in parallel. A particulate trap 108 can have a generally cylindrical spherical of tubular shaped configuration having any suitable inner diameter. Generally, as the inner diameter and length of the particulate trap 108 increases, the volume increases. As the volume increases, the capacity of the particulate trap 108 to remove contaminants also increases. Additionally, as the diameter increases, the pressure drop from the inlet to the outlet decreases, and the run time of a particulate trap can increase. For example, in one commercial application, a single vertical particulate trap having a nominal two meter bed depth and an inner diameter of 1500 MM can have a contaminant capacity equivalent to about 45 operating days, a single vertical particulate trap having a nominal two meter bed depth and an inner diameter of 1800 MM can have a contaminant capacity greater than about 60 operating days, and a single vertical particulate trap having a nominal two meter bed depth and an inner diameter of 2100 MM can have a contaminant capacity greater than about 90 operating days.

The treatment zones of particulate trap 108 can include a gross solids filtration zone 114, a fine solids filtration zone 116, and a reactive zone 118. The particulate trap can also include other structures, such as collection trays.

The gross solids filtration zone 114 can include a gross solids filtration media. The gross solids filtration media preferably includes a structured packing material that has an inter-particle voidage greater than about 50%. The structured packing material can be a regenerable structured packing material, such as a mechanically regenerable structured packing material, and is preferably non-catalytic. Mechanically regenerable structured packing materials include, for example, stainless steel rings such as Super Raschig® rings.

The fine solids filtration zone 116 can include a fine solids filtration media. The fine solids filtration media is preferably non-catalytic, and preferably has a smaller inter-particle voidage size than the gross solids filtration media. For example, the fine solids-filtration media can have an inter-particle voidage, or an inner particle voidage, depending upon the nature of the filtration media, greater than about 20%. Inter-particle voidage refers to the voidage between particles, and inner particle voidage refers to the voidage within a particle. Fine solids filtration media in the fine solids filtration zone 116 can be of a single size, or can include a plurality of sizes, such as a plurality of graded sizes. Fine solids filtration media can be structured packing material, and can include, for example, non-metallic solids such as reticulated ceramic materials, stainless steel rings, or combinations thereof. Reticulated ceramic materials are one example of a filtration media that has an inner particle voidage. Suitable reticulated ceramic materials can be, for example, Cat-Trap materials provided by Crystaphase® in Houston, Tex. Suitable stainless steel rings can be, for example, Super Raschig® rings.

The reactive zone 118 can include a catalytic media. The catalytic media can be, for example, a sulfided catalyst, such as the sulfided catalysts typically utilized in coker distillate hydrotreating units to remove silicon and phosphorous containing compounds. The catalytic media is preferably adapted to remove at least one of silicon, phosphorous, or arsenic. For example, phosphorous contamination is of particular concern in Hylube processes, and silicon contamination is of particular concern in slurry hydrocracking processes.

Referring back to FIG. 1, the particulate trap effluent 110 can be passed directly to a catalytic hydrogenation zone 112. The catalytic hydrogenation zone 112 preferably includes a fixed bed reactor, although a fluidized bed or an ebullated bed can be utilized. The particulate trap effluent 110 can be contacted with a hydrogenation catalyst in the catalytic hydrogenation zone 112 to produce a hydrocarbonaceous effluent 120. In some examples, the particulate trap effluent 110 is contacted with the hydrogenation catalyst in the presence of hydrogen in catalytic hydrogenation zone 112. The catalytic hydrogenation zone 112 can have an operation temperature of about 100° C. to about 450° C. (about 212° F. to about 842° F.). The catalytic hydrogenation zone 112 can have an operation pressure of from about 50 psi to about 3000 psi, or from about 400 psi to about 1200 psi. Preferably, the operation pressure of the particulate trap 108 and the operation pressure of the catalytic hydrogenation zone 112 have a difference of about 50 psi or less. It is also preferred that the operation pressure of the vapor liquid separator 102 and the operation pressure of the catalytic hydrogenation zone 112 have a difference of about 100 psi or less.

In some examples, at least two vapor liquid separators can be utilized. In such processes, the vapor liquid separator 102 can be a first vapor liquid separator. The liquid stream 106 of the first vapor liquid separator 102 can be passed from the first vapor liquid separator 102 to a second vapor liquid separator (not shown). The second vapor liquid separator can produce an overhead vapor stream and a liquid bottoms stream. The second vapor liquid separator preferably has an operation pressure that is less than the operation pressure of the first pressurized vapor liquid separator 102. The overhead vapor stream from the second vapor liquid separator can be condensed to form a liquid overhead stream 122. The liquid overhead stream 122 can be provided to the inlet of the catalytic hydrogenation zone 112, or can be combined with the particulate trap effluent 110 prior to being passed to the catalytic hydrogenation zone 112. Preferably, however, the liquid overhead stream 122 can be routed to the inlet of the particulate trap. It has been found that providing the liquid overhead stream 122 to the particulate trap 108 can result in a reduction of the temperature at the inlet of the particulate trap 108, can allow at least some condensation of volatile contaminants, and can facilitate the reduction or prevention of excess solids build up or particle bridging at the particulate trap inlet.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A process for removing contaminants from a vapor stream containing hydrocarbon and hydrogen, the process comprising:

providing a feed stream to a first pressurized vapor liquid separator that produces a liquid stream and a vapor stream containing hydrocarbon and hydrogen, wherein the pressurized vapor liquid separator has an operation pressure of from about 50 psi to about 3000 psi;

passing the vapor stream to an inlet of a particulate trap containing a plurality of treatment zones that remove contaminants from the vapor stream to produce a particulate trap effluent, wherein the particulate trap has an operation pressure of from about 50 psi to about 3000 psi; and passing the particulate trap effluent directly to a catalytic hydrogenation zone, wherein the hydrogenation zone has an operation pressure of from about 50 psi to about 3000 psi.

2. The process of claim 1, wherein the operation pressure of the pressurized vapor liquid separator and the operation pressure of the particulate trap have a difference of about 50 psi or less, and the operation pressure of the particulate trap and the operation pressure of the catalytic hydrogenation zone have a difference of about 50 psi or less.

3. The process of claim 1, wherein the contaminants removed from the vapor stream comprise at least one of inorganic contaminants or non-volatile carbonaceous contaminants.

4. The process of claim 1, wherein the feed stream comprises at least one of a waste lubricating oil, a pyrolysis oil, or an effluent stream from a slurry hydrocracking reactor.

5. The process of claim 1, wherein the catalytic hydrogenation zone is a fixed bed reactor.

6. The process of claim 1, wherein treatment zones of the particulate trap comprise a gross solids filtration zone, a fine solids filtration zone and a reactive zone.

7. The process of claim 6, wherein the gross solids filtration zone has a gross solids filtration media including a structured packing material that has an inter-particle voidage greater than about 50%.

8. The process of claim 7, wherein the fine solids filtration zone has a fine solids filtration media including structured packing material having a smaller inter-particle voidage size than the gross solids filtration media.

9. The method of claim 6, wherein the fine solids filtration zone has a fine solids filtration media including reticulated ceramic material having an inner-particle voidage greater than about 20%.

10. The process of claim 6, wherein the reactive zone has a catalytic media including a sulfided catalyst.

11. The process of claim 1, further comprising:

passing the liquid stream from the first pressurized vapor liquid separator to a second vapor liquid separator that produces an overhead vapor stream and a liquid bottoms stream, wherein the second vapor liquid separator has an operation pressure less than the first pressurized vapor liquid separator;

condensing the overhead vapor stream from the second vapor liquid separator to form a liquid overhead stream; and routing the liquid overhead stream to the inlet of the particulate trap.

12. The process of claim 1, wherein the hydrogen in the vapor stream has a partial pressure that is up to about 95% of the total pressure of the vapor stream.

13. A process for removing contaminants from a vapor stream containing hydrocarbon and hydrogen, the process comprising:

providing a feed stream to a first pressurized vapor liquid separator that produces a liquid stream and a vapor stream containing hydrocarbon and hydrogen, wherein the pressurized vapor liquid separator has an operation pressure of from about 50 psi to about 3000 psi;

passing the vapor stream to an inlet of a particulate trap containing a plurality of treatment zones that remove contaminants from the vapor stream to produce a particulate trap effluent, wherein the particulate trap has an operation pressure that differs from the operation pressure of the first pressurized vapor liquid separator by an amount of about 50 psi or less, and the contaminants include at least one of inorganic contaminants or non-volatile carbonaceous contaminants; and passing the particulate trap effluent directly to a catalytic hydrogenation zone, wherein the catalytic hydrogenation zone has an operation pressure that differs from the operation pressure of the particulate trap by an amount of about 50 psi or less.

14. The process of claim 13, wherein the feed stream comprises at least one of a waste lubricating oil, a pyrolysis oil, or an effluent stream from a slurry hydrocracking reactor.

15. The process of claim 13, wherein treatment zones of the particulate trap comprise a gross solids filtration zone, a fine solids filtration zone and a reactive zone.

16. The process of claim 15, wherein the gross solids filtration zone has a gross solids filtration media including a structured packing material that has an inter-particle voidage greater than about 50%.

17. The process of claim 16, wherein the fine solids filtration zone has a fine solids filtration media including structured packing material having a smaller inter-particle voidage size than the gross solids filtration media.

18. The process of claim 15, wherein the reactive zone has a catalytic media including a sulfided catalyst.

19. The process of claim 13, further comprising:

passing the liquid stream from the first pressurized vapor liquid separator to a second vapor liquid separator that produces an overhead vapor stream and a liquid bottoms stream, wherein the second vapor liquid separator has an operation pressure less than the first pressurized vapor liquid separator;

condensing the overhead vapor stream from the second vapor liquid separator to form a condensed overhead stream; and passing the condensed overhead stream to the inlet of the particulate trap.

* * * * *